US008920122B2

(12) United States Patent
Lee

(10) Patent No.: US 8,920,122 B2
(45) Date of Patent: Dec. 30, 2014

(54) TURBINE AIRFOIL WITH AN INTERNAL COOLING SYSTEM HAVING VORTEX FORMING TURBULATORS

(75) Inventor: Ching-Pang Lee, Cincinnati, OH (US)

(73) Assignee: Siemens Energy, Inc., Orlando, FL (US)

( * ) Notice: Subject to any disclaimer, the term of this patent is extended or adjusted under 35 U.S.C. 154(b) by 294 days.

(21) Appl. No.: 13/417,714

(22) Filed: Mar. 12, 2012

(65) Prior Publication Data

US 2013/0236330 A1 Sep. 12, 2013

(51) Int. Cl.
*F01D 5/18* (2006.01)

(52) U.S. Cl.
USPC ..... 416/97 R

(58) Field of Classification Search
CPC ..... F01D 5/14; F01D 5/147; F01D 5/18; F01D 5/181; F01D 5/188
USPC ..... 416/97 R, 97 A, 223 R, 232, 233
See application file for complete search history.

(56) References Cited

U.S. PATENT DOCUMENTS

| | | | | |
|---|---|---|---|---|
| 3,171,631 | A * | 3/1965 | Aspinwall | 416/90 R |
| 4,514,144 | A | 4/1985 | Lee | |
| 5,395,212 | A | 3/1995 | Anzai et al. | |
| 5,681,144 | A | 10/1997 | Spring et al. | |
| 5,797,726 | A | 8/1998 | Lee | |
| 6,227,804 | B1 * | 5/2001 | Koga et al. | 416/96 R |
| 6,331,098 | B1 | 12/2001 | Lee | |
| 6,554,571 | B1 | 4/2003 | Lee et al. | |
| 6,984,102 | B2 | 1/2006 | Bunker et al. | |
| 7,008,179 | B2 | 3/2006 | Rinck et al. | |
| 7,094,031 | B2 | 8/2006 | Lee et al. | |
| 7,156,619 | B2 | 1/2007 | Papple | |
| 7,513,745 | B2 | 4/2009 | Abdel-Messeh et al. | |
| 7,575,414 | B2 | 8/2009 | Lee | |
| 7,637,720 | B1 | 12/2009 | Liang | |
| 7,686,581 | B2 | 3/2010 | Brittingham et al. | |
| 7,699,583 | B2 | 4/2010 | Cunha | |
| 2007/0224048 | A1 | 9/2007 | Abdel-Messeh et al. | |
| 2009/0047136 | A1 | 2/2009 | Chon et al. | |
| 2009/0087312 | A1 | 4/2009 | Bunker et al. | |
| 2009/0104035 | A1 | 4/2009 | Abdel-Messeh et al. | |
| 2009/0148305 | A1 | 6/2009 | Riahi et al. | |
| 2009/0317234 | A1 | 12/2009 | Zausner et al. | |
| 2010/0054952 | A1 | 3/2010 | Gross | |
| 2010/0068066 | A1 | 3/2010 | Bunker | |
| 2010/0183427 | A1 | 7/2010 | Liang | |

FOREIGN PATENT DOCUMENTS

| | | |
|---|---|---|
| EP | 1111190 | 6/2001 |
| JP | 2000291406 | 10/2000 |
| JP | 2009085219 | 4/2009 |
| WO | 2004029416 | 4/2004 |

* cited by examiner

*Primary Examiner* — Ned Landrum
*Assistant Examiner* — Kayla McCaffrey

(57) ABSTRACT

A turbine airfoil usable in a turbine engine and having at least one cooling system is disclosed. At least a portion of the cooling system may include one or more cooling channels having a plurality of turbulators protruding from an inner surface and positioned generally nonorthogonal and nonparallel to a longitudinal axis of the airfoil cooling channel. The configuration of turbulators may create a higher internal convective cooling potential for the blade cooling passage, thereby generating a high rate of internal convective heat transfer and attendant improvement in overall cooling performance. This translates into a reduction in cooling fluid demand and better turbine performance.

8 Claims, 3 Drawing Sheets

TURBINE AIRFOIL WITH AN INTERNAL COOLING SYSTEM HAVING VORTEX FORMING TURBULATORS

STATEMENT REGARDING FEDERALLY SPONSORED RESEARCH OR DEVELOPMENT

Development of this invention was supported in part by the United States Department of Energy, Advanced Turbine Development Program, Contract No. DE-FC26-05NT42644. Accordingly, the United States Government may have certain rights in this invention.

FIELD OF THE INVENTION

This invention is directed generally to turbine airfoils, and more particularly to hollow turbine airfoils having cooling channels for passing fluids, such as air, to cool the airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine blades are formed from an elongated portion forming a blade having one end configured to be coupled to a turbine blade carrier and an opposite end configured to form a blade tip. The blade is ordinarily composed of a leading edge, a trailing edge, a suction side, and a pressure side. The inner aspects of most turbine blades typically contain an intricate maze of cooling circuits forming a cooling system. The cooling circuits in the blades receive air from the compressor of the turbine engine and pass the air through the ends of the blade adapted to be coupled to the blade carrier. The cooling circuits often include multiple flow paths that are designed to maintain all aspects of the turbine blade at a relatively uniform temperature. At least some of the air passing through these cooling circuits is exhausted through orifices in the leading edge, trailing edge, suction side, and pressure side of the blade. While advances have been made in the cooling systems in turbine blades, a need still exists for a turbine blade having increased cooling efficiency for dissipating heat and passing a sufficient amount of cooling air through the blade.

SUMMARY OF THE INVENTION

A turbine airfoil cooling system configured to cool internal and external aspects of a turbine airfoil usable in a turbine engine is disclosed. In at least one embodiment, the turbine airfoil cooling system may be configured to be included within a turbine blade. While the description below focuses on a cooling system in a turbine blade, the cooling system may also be adapted to be used in a stationary turbine vane. The turbine airfoil cooling system may be formed from a cooling system having one or more cooling channels having any appropriate configuration. The cooling channels may include a plurality of turbulators for creating vortices within the cooling channels to increase the internal convective cooling potential of the cooling system, thereby increasing the overall performance of the cooling system.

A turbine airfoil may be formed from a generally elongated hollow airfoil formed from an outer wall, and having a leading edge, a trailing edge, a pressure side, a suction side, a root at a first end of the airfoil and a tip at a second end opposite to the first end, and a cooling system positioned within interior aspects of the generally elongated hollow airfoil. The turbine airfoil may include at least one cooling channel of the cooling system in the generally elongated hollow airfoil formed from an inner surface. The turbine airfoil may also include a plurality of center turbulators extending from the inner surface into the cooling channel and may form a set of center turbulators that are positioned nonorthogonally and nonparallel relative to a longitudinal axis of the cooling channel. The turbine airfoil may also include one or more outer turbulators extending from the inner surface into the at least one cooling channel and may be positioned nonorthogonally and nonparallel relative to a longitudinal axis of the cooling channel. In at least one embodiment, there may exist a plurality of outer turbulators in the cooling channel. The outer turbulator may have a leading edge that is positioned radially outward from the longitudinal axis and a trailing edge that is positioned radially outward further from the longitudinal axis than a trailing edge of the center turbulators. The outer turbulator may be offset in a downstream direction from at least one of the center turbulators.

The set of center turbulators may be formed from a right side set of center turbulators and a left side set of center turbulators. The right side set of center turbulators may extend nonorthogonally and nonparallel relative to the longitudinal axis and may be a mirror image of the left side set of center turbulators such that leading edges of center turbulators from the right side set are aligned and trailing edges of center turbulators from the left side set and trailing edges of the right side set are positioned downstream from the leading edges and radially outward from the longitudinal axis in generally opposite directions. A center gap may separate the right side set of center turbulators from the left side set of center turbulators. The outer turbulator may be formed from a set of outer turbulators having a first set of outer turbulators offset to a right side of the longitudinal axis and a second set of outer turbulators offset to a left side of the longitudinal axis, wherein an outer gap extending between leading edges of a radially adjacent outer turbulators is larger than the center gap. The right side set of center turbulators may be positioned at a same angle relative to the longitudinal axis as the right side set of outer turbulators, and the left side set of center turbulators may be positioned at a same angle relative to the longitudinal axis as the left side set of outer turbulators.

The trailing edge of the outer turbulator may be positioned laterally upstream from a leading edge of the center turbulator positioned immediately downstream. The trailing edge of the outer turbulator may be laterally aligned along the longitudinal axis with a leading edge of the center turbulator. In one embodiment, the set of outer turbulators may be offset to a right side of the longitudinal axis. In another embodiment, the set of outer turbulators may be offset to a left side of the longitudinal axis. In yet another embodiment, the set of outer turbulators may be formed from a first set of outer turbulators offset to a right side of the longitudinal axis and a second set of outer turbulators offset to a left side of the longitudinal axis. The outer turbulator may be positioned at a same angle with respect to the longitudinal axis as the center turbulator. A trailing edge of the center turbulator may terminate at a second longitudinal axis extending longitudinally in the at least one cooling channel and a leading edge of the at least one outer turbulator may extend from the second longitudinal axis, wherein the leading edge of the at least one outer turbulator is offset downstream from the trailing edge of the center turbulator.

During use, the cooling fluids may be passed into the cooling channel. The upstream corner of the center turbulator trips the boundary layer and creates turbulence. The turbulent cooling fluids form a vortex downstream of the turbulator that rolls along the length of the turbulator. However, the vortex rolls downstream and away from the turbulator by the incoming cooling fluids flowing over the turbulator. As the vortices propagate along the full length of the downstream side of center turbulators, the boundary layer becomes progressively more disturbed or thickened, but the outer turbulators disrupt such boundary layer formation, thereby preventing boundary layer growth that significantly reduces heat transfer augmentation. The vortex continues to increase in diameter as the vortex rolls away from the turbulator. The vortex may be disrupted by a downstream outer turbulator positioned downstream and radially outward from the center turbulator. The sets of center and outer turbulators effectively dissipate boundary layers of cooling fluids in cooling channels in industrial gas turbine engines. This unique vortex turbulator cooling arrangement formed by the sets of center and outer turbulators creates higher internal convective cooling potential for the turbine blade cooling channel, thus generating a high rate of internal convective heat transfer and efficient overall cooling system performance. This performance equates to a reduction in cooling demand and better turbine engine performance.

An advantage of this invention is that the turbine airfoil cooling system is configured to cool cooling channels and because of its configuration is particularly well suited to cool cooling channels in industrial gas turbine engines.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
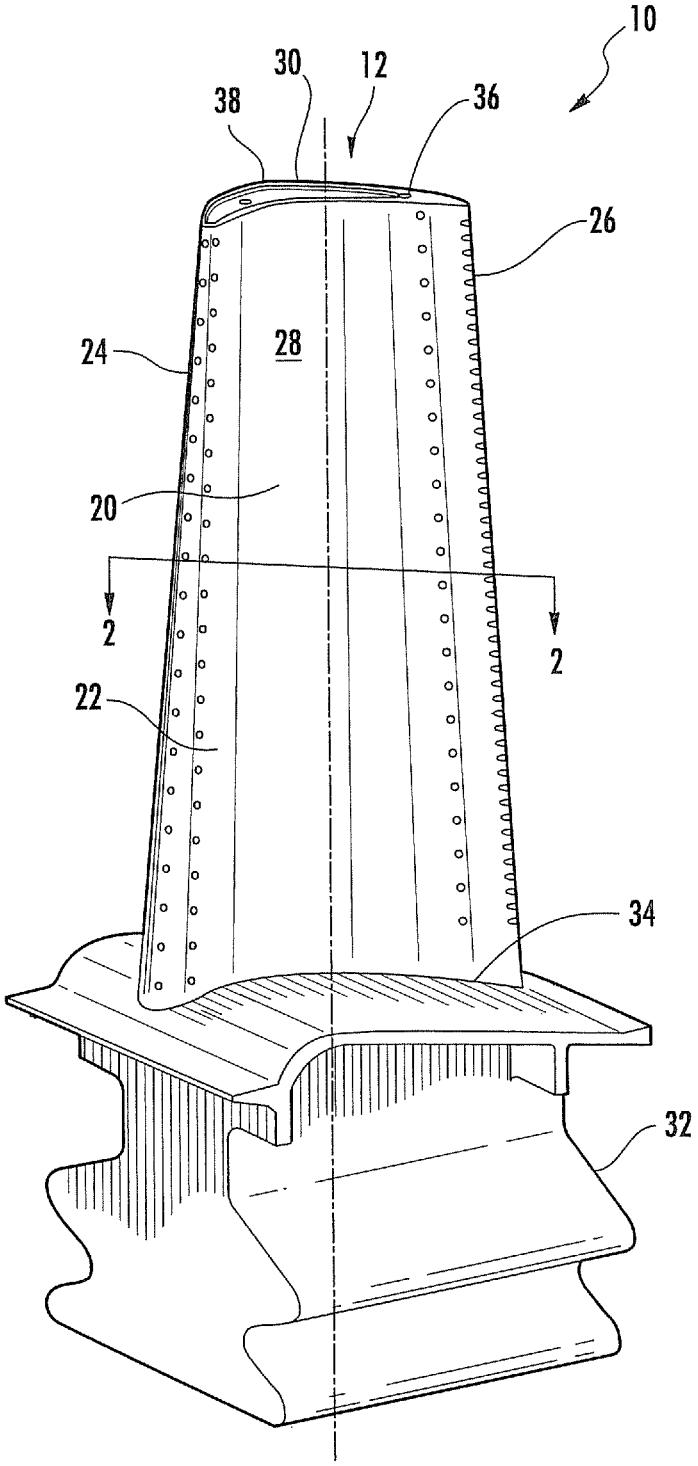
FIG. 1 is a perspective view of a turbine airfoil having features according to the instant invention.
Figure 2:
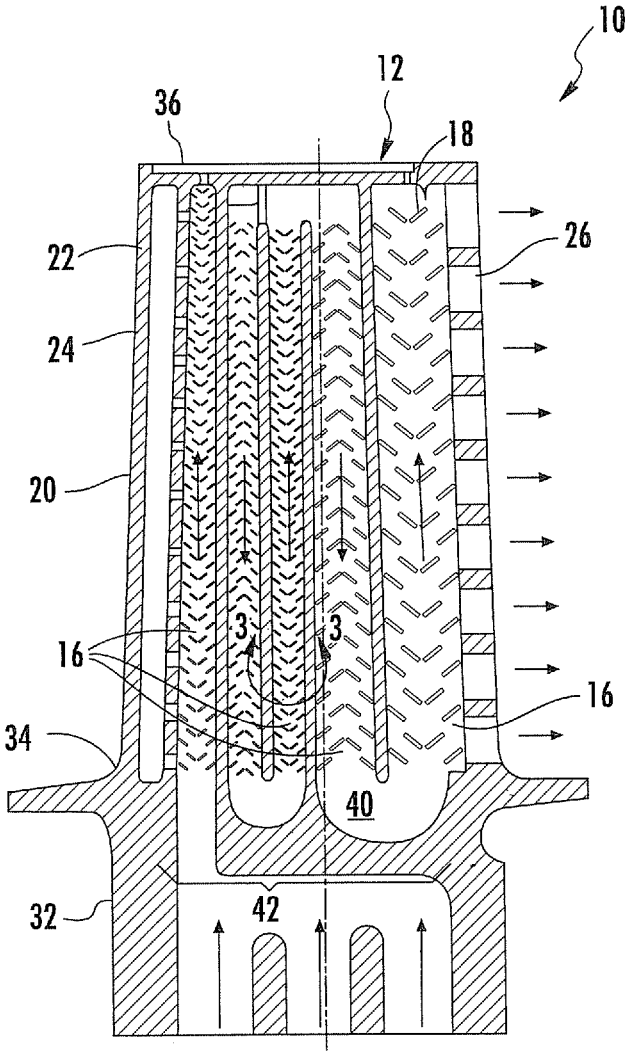
FIG. 2 is a cross-sectional view of the turbine airfoil shown in FIG. 1 taken along line 2-2.

As shown in FIGS. 1-5, this invention is directed to a turbine airfoil cooling system 10 configured to cool internal and external aspects of a turbine airfoil 12 usable in a turbine engine. In at least one embodiment, the turbine airfoil cooling system 10 may be configured to be included within a turbine blade, as shown in FIGS. 1-5. While the description below focuses on a cooling system 10 in a turbine blade 12, the cooling system 10 may also be adapted to be used in a stationary turbine vane. The turbine airfoil cooling system 10 may be formed from a cooling system 10 having one or more cooling channels 16 having any appropriate configuration, as shown in FIGS. 2-5. The cooling channels 16 may include a plurality of turbulators 18 for creating vortices within the cooling channels 16 to increase the internal convective cooling potential of the cooling system, thereby increasing the overall performance of the cooling system 10.

The turbine airfoil 12 has a generally elongated hollow airfoil 20 formed from an outer wall 22. The generally elongated hollow airfoil 20 may have a leading edge 24, a trailing edge 26, a pressure side 28, a suction side 30, a root 32 at a first end 34 of the airfoil 20 and a tip 36 at a second end 38 opposite to the first end 34. The generally elongated hollow airfoil 20 may have any appropriate configuration and may be formed from any appropriate material. The cooling system 10 may be positioned within interior aspects of the generally elongated hollow airfoil. One or more cooling channels 16 of the cooling system 10 may be positioned in the generally elongated hollow airfoil 20 and formed from an inner surface 40. The inner surface 40 may define the cooling channel 16. The cooling channel 16 may have any appropriate cross-sectional shape. The cooling channel 16 may be positioned at the leading edge 24, the mid-chord section 42, or the trailing edge 26.

One or more center turbulators 44 may extend from the inner surface 40 into the cooling channel 16 to dissipate any film layer of cooling fluids. In at least one embodiment, there may exist a plurality of center turbulators 44 forming a set of center turbulators 44 that are positioned nonorthogonally and nonparallel relative to a longitudinal axis 46 of the cooling channel 16. The set of center turbulators may be aligned along a longitudinal axis. One or more outer turbulators 48 may extend from the inner surface 40 into the cooling channel 16 and may be positioned nonorthogonally and nonparallel relative to the longitudinal axis 46 of the cooling channel 16.

One or more of the turbulators 18 may have a height from the inner surface 40 of the cooling channel 16 that may be about one quarter or less of a distance between the pressure side 28 and the suction side 30. In other embodiments, the height of the turbulators 18, including the center and outer turbulators, 44, 48, may be less than one sixteenth of the height of the distance between the pressure side 28 and the suction side 30. The center turbulators 44 may be spaced from adjacent center turbulators 44 equally, in a repetitive pattern or randomly. The outer turbulators 48 may be spaced from adjacent outer turbulators 48 equally, in a repetitive pattern or randomly.

Figure 3:
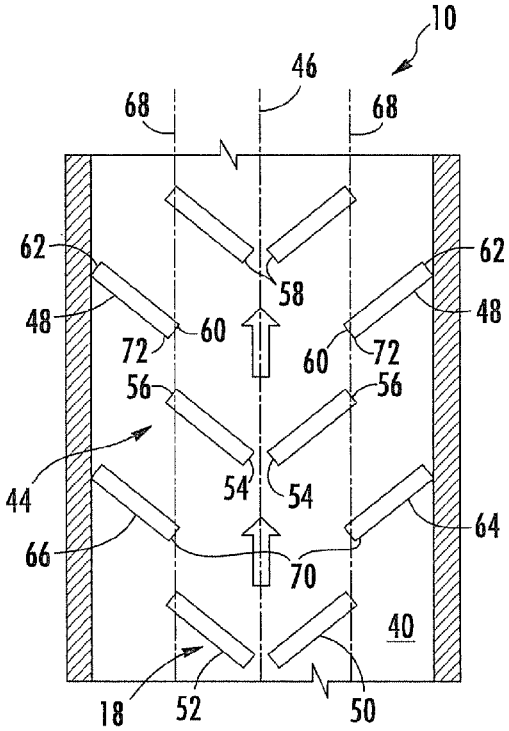
FIG. 3 is a partial detailed view of the cooling system in the turbine airfoil shown in FIG. 2 taken along line 3-3 in FIG. 2.
Figure 4:
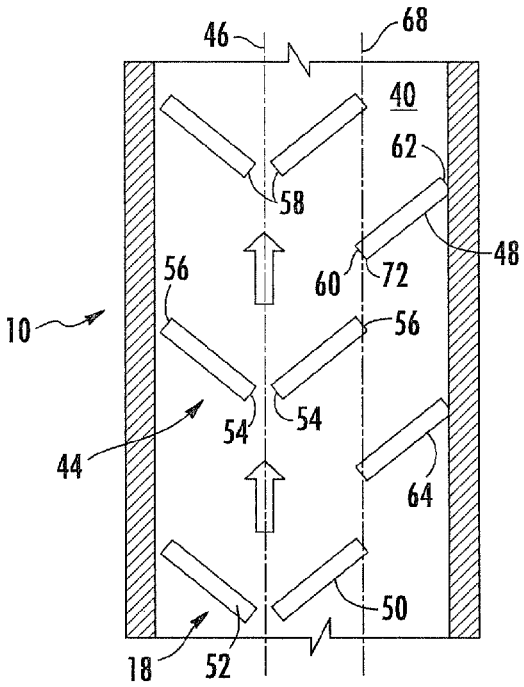
FIG. 4 is a partial detailed view of an alternative configuration of the cooling system in the turbine airfoil shown in FIG. 2 taken along line 3-3 in FIG. 2.
Figure 5:
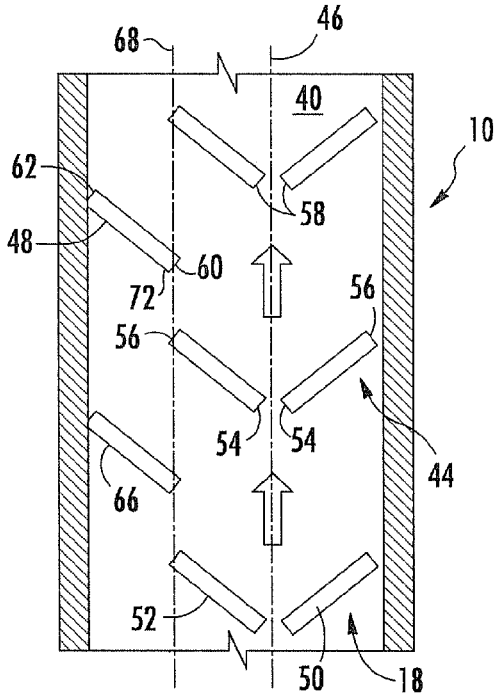
FIG. 5 is a partial detailed view of another alternative configuration of the cooling system in the turbine airfoil shown in FIG. 2 taken along line 3-3 in FIG. 2.

In embodiments shown in FIGS. 3-5, the set of center turbulators 44 may be formed from a right side set 50 of center turbulators 44 and a left side set 52 of center turbulators 44. The right side set 50 of center turbulators 44 may extend nonorthogonally and nonparallel relative to the longitudinal axis 46 and may be a mirror image of the left side set 52 of center turbulators 44 such that leading edges 54 of center turbulators 44 from the right side set 50 and the left side set 52 are aligned and trailing edges 56 of center turbulators 44 from the left side set 52 and trailing edges 56 of the right side set 50 are positioned downstream from the leading edges 54 and radially outward from the longitudinal axis 46 in generally opposite directions. The right side set 50 of center turbulators 44 may be positioned nonorthogonally and nonparallel relative to the left side set 52 of center turbulators 44. In another embodiment, the right side set 50 of center turbulators 44 may be positioned orthogonally relative to the left side set 52 of center turbulators 44. A center gap 58 may separate the right side set 50 of center turbulators 44 from the left side set 52 of center turbulators 44. The center gap 58 between adjacent center turbulators 44 may be the same distance or may vary. The center gap 58 may have a distance less than one quarter of a length of a center turbulator 44.

One or more outer turbulators 48 may extend from the inner surface 40 into the cooling channel 16 and may be positioned nonorthogonally and nonparallel relative to the longitudinal axis 46 of the cooling channel 16. In one embodiment, a plurality of outer turbulators 48 may be positioned in the cooling channel 16. The outer turbulator 48 may have a leading edge 60 that is positioned radially outward from the longitudinal axis 46 and a trailing edge 62 that is positioned radially outward further from the longitudinal axis 46 than a trailing edge 56 of the center turbulators 44. The outer turbulator 48 may be offset in a downstream direction from at least one of the center turbulators 44. The trailing edge 62 of the outer turbulator 48 may be positioned laterally upstream from a leading edge 54 of the center turbulator 44 positioned immediately downstream. The trailing edge 62 of the outer turbulator 48 may be laterally aligned along the longitudinal axis 46 with a leading edge 54 of the center turbulator 44.

As shown in FIG. 4, the plurality of outer turbulators 48 may form a set of outer turbulators 48 offset to a right side of the longitudinal axis 46 when viewed downstream along the longitudinal axis 46. In another embodiment, as shown in FIG. 5, the plurality of outer turbulators 48 may form a set of outer turbulators 48 offset to a left side of the longitudinal axis 46 when viewed downstream along the longitudinal axis 46. In yet another embodiment, as shown in FIG. 3, the set of outer turbulators 48 may be formed from a first set 64, referred to as a right side set, of outer turbulators 48 offset to a right side of the longitudinal axis 46 and a second set 66, referred to as a left side set, of outer turbulators 48 offset to a left side of the longitudinal axis 46. The outer turbulator 48 may be positioned at a same angle with respect to the longitudinal axis 46 as the center turbulator 44. A trailing edge of the center turbulator 44 may terminate at a second longitudinal axis 68 extending longitudinally in the cooling channel 16 and a leading edge 60 of the outer turbulator 48 may extend from the second longitudinal axis 68. The leading edge 60 of the outer turbulator 48 may be offset downstream from the trailing edge 56 of the center turbulator 44.

As shown in FIG. 3, an outer gap 70 extending between leading edges 60 of a radially adjacent outer turbulators 48 may be larger than the center gap 58. As such, the outer turbulators 48 are positioned in a radial direction further in a radial direction from the longitudinal axis than the center turbulators 44. The right side set 50 of center turbulators 44 may be positioned at a same angle relative to the longitudinal axis 46 as the right side set 64 of outer turbulators 48. The left side set 52 of center turbulators 44 may be positioned at a same angle relative to the longitudinal axis 46 as the left side set 66 of outer turbulators 48.

During use, the cooling fluids may be passed into the cooling channel 16. The upstream corner 72 of the leading edge 54 of the center turbulator 44 trips the boundary layer and creates turbulence. The turbulent cooling fluids form a vortex downstream of the turbulator 44 that rolls along the length of the turbulator 44. However, the vortex rolls downstream and away from the turbulator 44 by the incoming cooling fluids flowing over the turbulator 18. As the vortices propagate along the full length of the downstream side of center turbulators 44, the boundary layer becomes progressively more disturbed or thickened, but the outer turbulators 48 disrupt such boundary layer formation, thereby preventing boundary layer growth that significantly reduces heat transfer augmentation. The vortex continues to increase in diameter as the vortex rolls away from the turbulator 44. The vortex may be disrupted by a downstream outer turbulator 48 positioned downstream and radially outward from the center turbulator 44. The sets of center and outer turbulators 44, 48 effectively dissipate convective cooling layers in cooling channels 16 in industrial gas turbine engines. This unique vortex turbulator cooling arrangement formed by the sets of center and outer turbulators, 44, 48 creates higher internal convective cooling potential for the turbine blade cooling channel 16, thus generating a high rate of internal convective heat transfer and efficient overall cooling system performance. This performance equates to a reduction in cooling demand and better turbine engine performance.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated hollow airfoil formed from an outer wall, and having a leading edge, a trailing edge, a pressure side, a suction side, a root at a first end of the airfoil and a tip at a second end opposite to the first end, and a cooling system positioned within interior aspects of the generally elongated hollow airfoil;

at least one cooling channel of the cooling system in the generally elongated hollow airfoil formed from an inner surface;

a plurality of center turbulators extending from the inner surface into the at least one cooling channel and forming a set of center turbulators that are positioned nonorthogonally and nonparallel relative to a longitudinal axis of the at least one cooling channel;

at least one outer turbulator extending from the inner surface into the at least one cooling channel and positioned nonorthogonally and nonparallel relative to the longitudinal axis of the at least one cooling channel;

wherein the at least one outer turbulator has a leading edge that is positioned radially outward from the longitudinal axis and a trailing edge that is positioned radially outward further from the longitudinal axis than a trailing edge of the center turbulators;

wherein the at least one outer turbulator is offset in a downstream direction from at least one of the center turbulators;

wherein the set of center turbulators is formed from a right side set of center turbulators and a left side set of center turbulators, wherein the right side set of center turbulators extend nonorthogonally and nonparallel relative to the longitudinal axis and are a mirror image of the left side set of center turbulators such that leading edges of center turbulators from the right side set are aligned and trailing edges of center turbulators from the left side set and trailing edges of the right side set are positioned downstream from the leading edges and radially outward from the longitudinal axis in generally opposite directions;

wherein a center gap separates the right side set of center turbulators from the left side set of center turbulators;

wherein the at least one outer turbulator is formed from a set of outer turbulators having a first set of outer turbulators offset to a right side of the longitudinal axis and a second set of outer turbulators offset to a left side of the longitudinal axis, wherein an outer gap extending between leading edges of a radially adjacent outer turbulators is larger than the center gap; and wherein the right side set of center turbulators is positioned at a same angle relative to the longitudinal axis as the right side set of outer turbulators; and wherein the left side set of center turbulators is positioned at a same angle relative to the longitudinal axis as the left side set of outer turbulators.

2. The turbine airfoil of claim 1, wherein the trailing edge of the at least one outer turbulator is positioned laterally upstream from a leading edge of the center turbulator positioned immediately downstream.

3. The turbine airfoil of claim 1, wherein the trailing edge of the at least one outer turbulator is laterally aligned with respect to the longitudinal axis with a leading edge of the center turbulator.

4. The turbine airfoil of claim 1, wherein a trailing edge of the center turbulator terminates at a second longitudinal axis extending longitudinally in the at least one cooling channel and a leading edge of the at least one outer turbulator extends from the second longitudinal axis, wherein the leading edge of the at least one outer turbulator is offset downstream from the trailing edge of the center turbulator.

5. A turbine airfoil, comprising:

a generally elongated hollow airfoil formed from an outer wall, and having a leading edge, a trailing edge, a pressure side, a suction side, a root at a first end of the airfoil and a tip at a second end opposite to the first end, and a cooling system positioned within interior aspects of the generally elongated hollow airfoil;

at least one cooling channel of the cooling system in the generally elongated hollow airfoil formed from an inner surface;

a plurality of center turbulators extending from the inner surface into the at least one cooling channel and forming a set of center turbulators that are positioned nonorthogonally and nonparallel relative to a longitudinal axis of the at least one cooling channel;

a plurality of outer turbulators forming a set of outer turbulators extending from the inner surface into the at least one cooling channel and positioned nonorthogonally and nonparallel relative to the longitudinal axis of the at least one cooling channel;

wherein each of the outer turbulators has a leading edge that is positioned radially outward from the longitudinal axis and a trailing edge that is positioned radially outward further from the longitudinal axis than a trailing edge of the center turbulators;

wherein each of the outer turbulators is offset in a downstream direction from at least one of the center turbulators and wherein the outer turbulators are positioned at a same angle with respect to the longitudinal axis as the center turbulator;

wherein the set of center turbulators is formed from a right side set of center turbulators and a left side set of center turbulators;

wherein the right side set of center turbulators extend nonorthogonally and nonparallel relative to the longitudinal axis and are a mirror image of the left side set of center turbulators such that leading edges of center turbulators from the right side set are aligned and trailing edges of center turbulators from the left side set and trailing edges of the right side set are positioned downstream from the leading edges and radially outward from the longitudinal axis in generally opposite directions; and wherein the set of outer turbulators is formed from a first set of outer turbulators offset to a right side of the longitudinal axis and a second set of outer turbulators offset to a left side of the longitudinal axis, wherein an outer gap extending between leading edges of a radially adjacent outer turbulators is larger than the center gap separating the right side set of center turbulators from the left side set of center turbulators.

6. The turbine airfoil of claim 5, wherein the right side set of center turbulators is positioned at a same angle relative to the longitudinal axis as the right side set of outer turbulators; and wherein the left side set of center turbulators is positioned at a same angle relative to the longitudinal axis as the left side set of outer turbulators.

7. A turbine airfoil, comprising:

a generally elongated hollow airfoil formed from an outer wall, and having a leading edge, a trailing edge, a pressure side, a suction side, a root at a first end of the airfoil and a tip at a second end opposite to the first end, and a cooling system positioned within interior aspects of the generally elongated hollow airfoil;

at least one cooling channel of the cooling system in the generally elongated hollow airfoil formed from an inner surface;

a plurality of center turbulators extending from the inner surface into the at least one cooling channel and forming a set of center turbulators that are positioned nonorthogonally and nonparallel relative to a longitudinal axis of the at least one cooling channel;

a plurality of outer turbulators forming a set of outer turbulators extending from the inner surface into the at least one cooling channel and positioned nonorthogonally and nonparallel relative to a longitudinal axis of the at least one cooling channel;

wherein each of the outer turbulators has a leading edge that is positioned radially outward from the longitudinal axis and a trailing edge that is positioned radially outward further from the longitudinal axis than a trailing edge of the center turbulators;

wherein each of the outer turbulators is offset in a downstream direction from at least one of the center turbulators and wherein the outer turbulators are positioned at a same angle with respect to the longitudinal axis as the center turbulator;

wherein the set of center turbulators is formed from a right side set of center turbulators and a left side set of center turbulators;

wherein the right side set of center turbulators extend nonorthogonally and nonparallel relative to the longitudinal axis and are a mirror image of the left side set of center turbulators such that leading edges of center turbulators from the right side set are aligned and trailing edges of center turbulators from the left side set and trailing edges of the right side set are positioned downstream from the leading edges and radially outward from the longitudinal axis in generally opposite directions;

wherein the set of outer turbulators is formed from a first set of outer turbulators offset to a right side of the longitudinal axis and a second set of outer turbulators offset to a left side of the longitudinal axis, wherein an outer gap extending between leading edges of a radially adjacent outer turbulators is larger than the center gap separating the right side set of center turbulators from the left side set of center turbulators; and wherein the right side set of center turbulators is positioned at a same angle relative to the longitudinal axis as the right side set of outer turbulators; and wherein the left side set of center turbulators is positioned at a same angle relative to the longitudinal axis as the left side set of outer turbulators.

8. The turbine airfoil of claim 7, wherein the trailing edge of the center turbulator terminates at a second longitudinal axis extending longitudinally in the at least one cooling channel and a leading edge of the at least one outer turbulator extends from the second longitudinal axis, wherein the leading edge of the at least one outer turbulator is offset downstream from the trailing edge of the center turbulator.

* * * * *